United States Patent [19]

Satoh et al.

[11] Patent Number: 4,808,775

[45] Date of Patent: Feb. 28, 1989

[54] REVERSING SWITCH

[75] Inventors: Hiroshi Satoh, Sakado; Minoru Mohri, Tokorozawa, both of Japan

[73] Assignee: Toyo Denso Kabushiki Kaisha, Tokyo, Japan

[21] Appl. No.: 80,763

[22] Filed: Aug. 3, 1987

[51] Int. Cl.[4] ..... H01H 9/00; H01H 21/02

[52] U.S. Cl. ..... 200/1 V; 200/241; 200/438

[58] Field of Search ..... 200/1 V, 6 R, 6 B, 6 BA, 200/6 BB, 68.1, 68.2, 68.3, 69, 164 R, 239–242, 315, 339

[56] References Cited

U.S. PATENT DOCUMENTS

| | | | |
|---|---|---|---|
| 3,294,932 | 12/1966 | Barlow | 200/68.2 |
| 3,305,650 | 2/1967 | Duffield et al. | 200/68.1 X |
| 3,670,116 | 6/1972 | Cryer | 200/68.1 X |
| 3,935,411 | 1/1976 | Ford | 200/68.2 |
| 4,123,634 | 10/1978 | Hults | 200/68.1 |
| 4,181,825 | 1/1980 | Epple | 200/1 V |
| 4,259,552 | 3/1981 | Swann | 200/68.3 X |
| 4,689,450 | 8/1987 | Sawada | 200/68.3 X |

*Primary Examiner*—J. R. Scott

*Attorney, Agent, or Firm*—Birch, Stewart, Kolasch & Birch

[57] ABSTRACT

In a reversing switch comprising a substantially V-shaped swinging contact plate provided with a normally open movable contact and a normally closed movable contact, a pair of fixed contacts provided in opposed relationship to the normally open movable contact and the normally closed movable contact, an intermediate supporting member for supporting a normally open contact side of a central bent portion of the swinging contact plate, and a knob adapted to be swung and slid on the swinging contact plate; the improvement is characterized in that the swinging contact plate is formed of an elastic material, and that the knob is provided at its end portion with a pressing member adapted to elastically deform the swinging contact plate. With this arrangement, the swinging contact plate is elastically deformed by the pressing member in association with the swinging motion of the knob, thereby wiping off a bad conductor present between the movable contact and the fixed contact.

7 Claims, 5 Drawing Sheets

REVERSING SWITCH

BACKGROUND OF THE INVENTION

1. Technical Field

This invention relates to a reversing switch, and more particularly to a reversing switch having a wiping function wherein when a bad conductor such as dust is deposited on a contact portion, it is automatically cleared off from the contact portion and the presence of the bad conductor may be eliminated.

2. Prior Art

Generally, the reversing switch is used for the purpose of reversing a direction of current, for example. The switch includes a substantially V-shaped swinging contact plate provided at both ends with a normally open movable contact and a normally closed movable contact, an intermediate supporting member for supporting a normally open contact side of a central bent portion of the swinging contact plate, a swingable knob having a pin at its lower end biased by a spring and adapted to be projected and retracted. When the knob is swung, the pin is slid on an arm portion of the swinging contact plate to thereby reversely incline the swinging contact plate and bring the normally open movable contact into contact with a fixed contact. The swinging contact plate is formed of a relatively hard member such that it is not deformed even when the pin is normally slid thereon.

If there is present a bad conductor such as dust between the movable contact and the fixed contact, the electrical connection between both the contacts are blocked. In the case that the normally open movable contact is switched on and off, an arc is generated to effect the wiping of the bad conductor, thus generating a relatively lesser problem. However, as the generation of the arc cannot be expected at the normally closed contact, it is necessary to swing the swinging contact plate many times to remove the bad conductor, and in the worst case, it is necessary to disassemble the reversing switch for cleaning. Further, in a manufacturing stage, such a reversing switch is necessarily abandoned from the viewpoint of efficiency.

Moreover, even at the normally open contact, it cannot be expected to completely carry out the wiping operation by the arc, and it is therefore required to reliably carry out the wiping operation.

SUMMARY OF THE INVENTION

It is an object of the present invention to provide a reversing switch which may automatically wipe off a bad conductor present between the movable and fixed contacts by utilizing the swinging motion of a knob.

It is another object of the present invention to provide a reversing switch which may carry out a wiping operation more reliably.

According to the present invention, the swinging contact plate is formed of an elastic conductive material, and the knob is provided at its end portion with a pressing member adapted to elastically deform the swinging contact plate. When the swinging contact plate is elastically deformed by the pressing member in association with the swinging motion of the knob, a contact position between the movable contact and the fixed contact is slipped, thereby wiping off a bad conductor present between both the contacts.

Accordingly, the bad conductor present between both the contacts may be reliably wiped off every time the knob is operated, thereby maintaining a good conductive condition.

Other objects and features of the invention will be more fully understood from the following detailed description and appended claims when taken with the accompanying drawings.

DETAILED DESCRIPTION OF THE PREFERRED EMBODIMENTS

Figure 1:
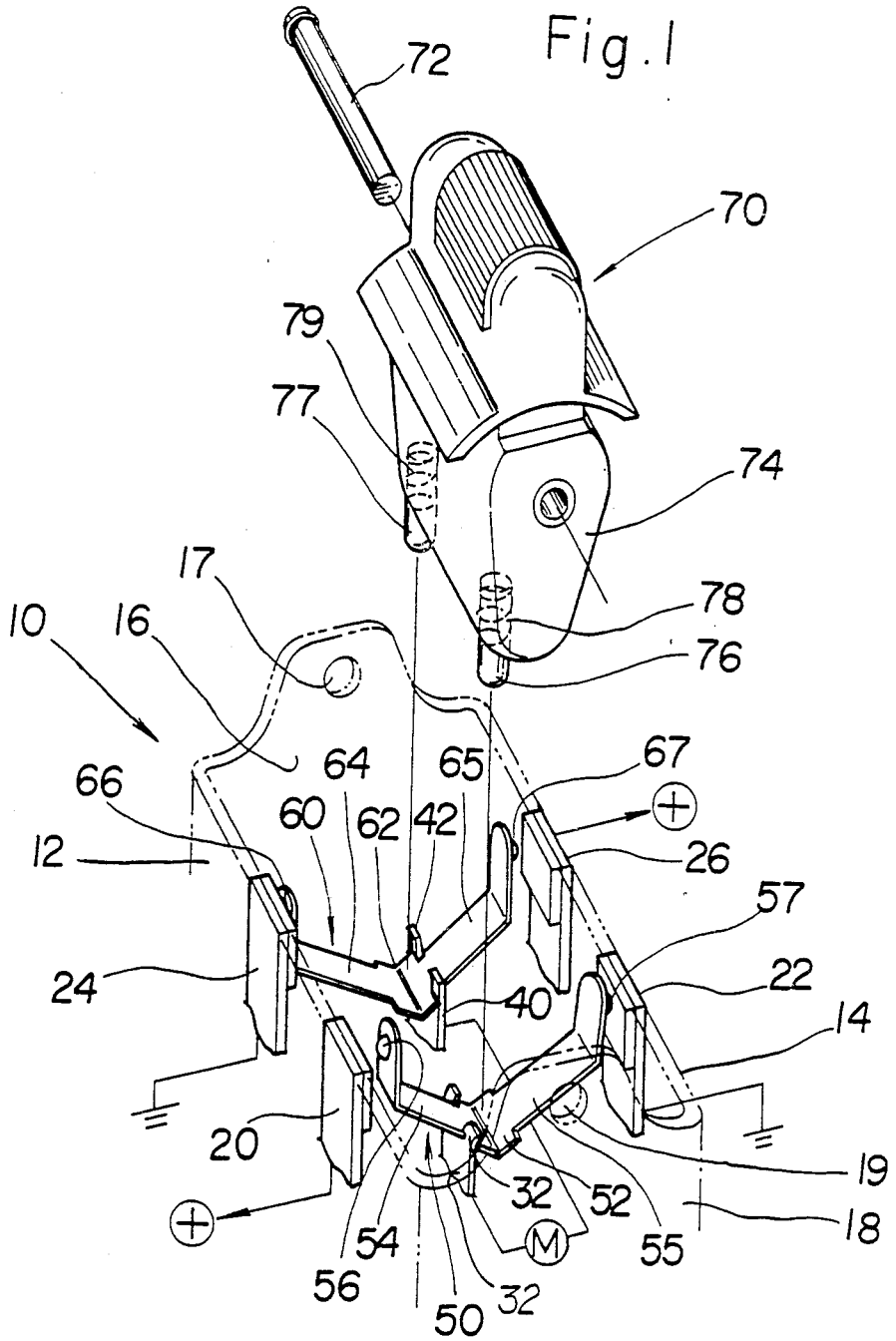
FIG. 1 is an exploded perspective view of the reversing switch in a first preferred embodiment of the present invention.
Figure 2:
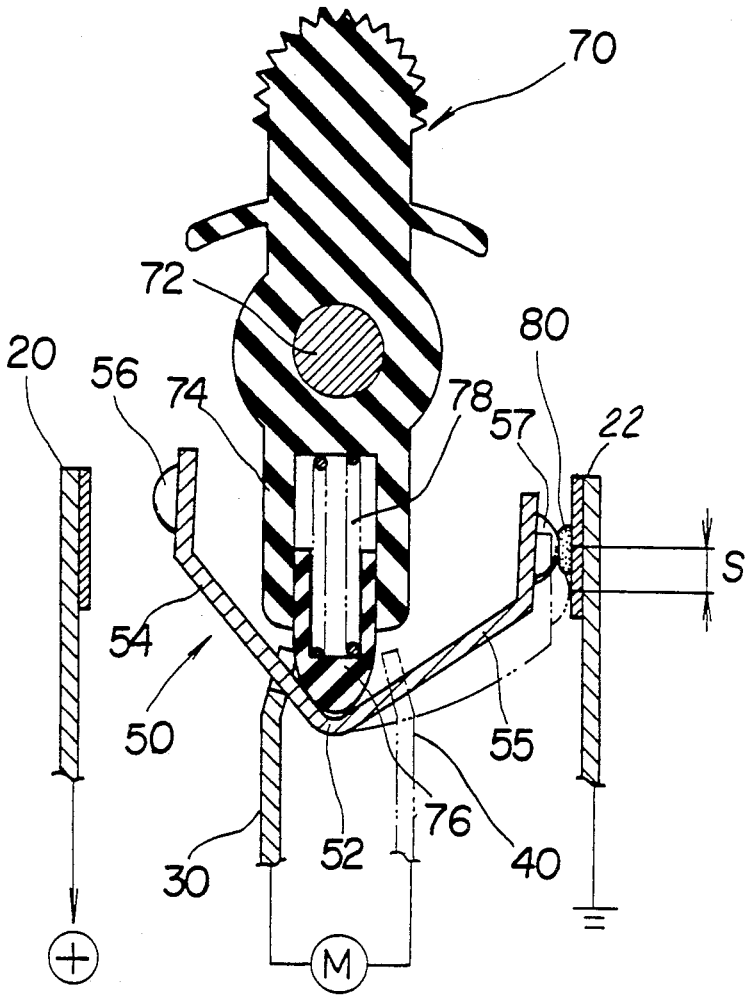
FIG. 2 is a partially enlarged sectional view of the reserving switch in the neutral position of the knob in the first embodiment.
Figure 3:
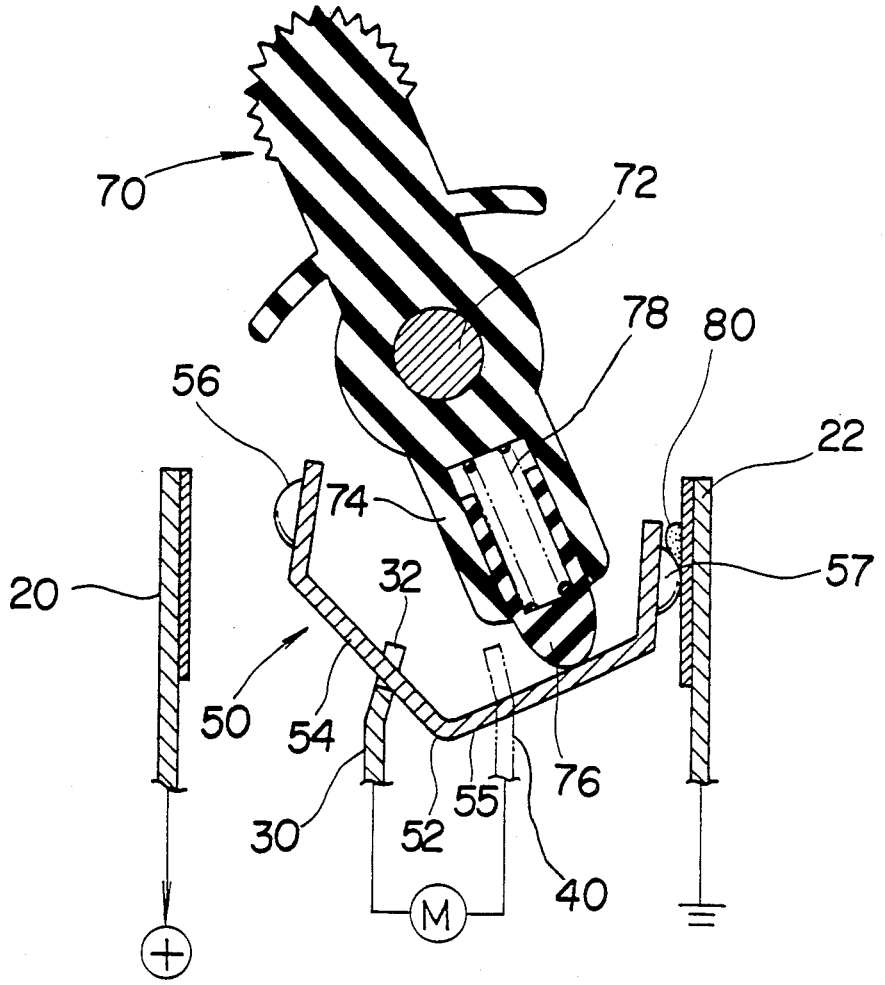
FIG. 3 is a sectional view similar to FIG. 2, showing the wiping operation.

FIGS. 1 to 3 show a first preferred embodiment of the present invention. The preferred embodiment relates to a reversing switch to be used for controlling the driving operation of a motor for raising and lowering a window glass in an automotive power window device. The reversing switch is formed in a box 10 made of insulating resin (schematically shown by a phantom line). A pair of fixed contacts 20 and 22 and another pair of fixed contacts 24 and 26 are provided along the inner surfaces of opposed wall portions 12 and 14 of the box 10. Intermediate supporting members 30 and 40 are formed to project from the bottom portion of the box 10 at respective intermediate positions of each pair of fixed contacts. The intermediate supporting members 30 and 40 are arranged in symmetrical relationship with respect to an intermediate position of the two pairs of fixed contacts. First and second swinging contact plates 50 and 60 are arranged in parallel to each other, and are supported to the intermediate supporting members 30 and 40. The first and second swinging contact plates 50 and 60 are reversely inclined by a knob 70 swingably supported above the contact plates 50 and 60.

The fixed contacts 20 and 26 are connected to a power source, while the fixed contacts 22 and 24 are connected to the ground. Further, a motor M is connected at both of its poles to the intermediate supporting members 30 and 40.

The first and second swinging contact plates 50 and 60 are formed of a substantially V-shaped elastic metal conductor such as a leaf spring. The swinging contact plates 50 and 60 are formed with central bent portions 52 and 62 having a relatively large width and with arm portions 54, 55 and 64, 65 upwardly inclined and extending from the bent portions 52 and 62, respectively. The arm portions 54, 55, 64 and 65 are vertically bent at their free end portions, and movable contacts 56, 57 and 66, 67 are provided at the respective vertical bent portions of the arm portions 54, 55 and 64, 65, respectively.

The intermediate supporting members 30 and 40 are formed at their upper ends with forked portions 32 and 42, respectively, and the forked portions 32 and 42 are engaged with the end portions of the bent portions 52 and 62 having a relatively small width, respectively.

Thus, the first and second contact plates 50 and 60 are supported in such a manner as to be inclined to one side. The direction of such inclination of the first contact plate 50 is contrary to that of the second contact plate 60. That is, in the neutral position, the movable contacts 57 and 66 form normally closed contacts contacting the fixed contacts 22 and 24, respectively. On the other hand, the movable contacts 56 and 67 form normally open contacts.

A shaft 72 is supported between supporting portions 17 and 19 formed at the upper end portions of opposed wall portions 16 and 18 of the box 10. The knob 70 is designed to be swung about the shaft 72. The knob 70 is formed with a pin holder 74 extending downwardly. A pair of pins 76 and 77 are engaged at the lower end portion of the pin holder 74 in such a manner as to be projectable and retractable. The pair of pins 76 and 77 are biased in the projecting direction by means of springs 78 and 79. The pins 76 and 77 are slidable on the arm portions 54, 55 and 64, 65, respectively, against the elastic force of the springs 78 and 79. When the pins 76 and 77 are positioned at the respective centers of the bent portions 52 and 62, they are retained in the neutral position, while when the pins 76 and 77 are positioned at the intermediate position of each arm portion, they generate a return force to move toward the neutral position by the return elasticity of the springs 78 and 79. Further, when the knob 70 is swung to outwardly move the pin 76 or 77 to a position beyond the supporting point of the intermediate supporting member 30 or 40, either of the first swinging contact plate 50 or the second swinging contact plate 60 is reversely inclined to close the respective normally open contact. Therefore, the direction of current flowing through the motor M may be reversed by swinging the knob 70 in either direction, thereby attaining forward and reverse rotations of the motor M. For example, supposing that when the normally open movable contact 56 is closed, the motor M is rotated forwardly to raise the window glass, the current flows through the fixed contact 20, the movable contact 56, the intermediate supporting members 30 and 40, the movable contact 66 and the fixed contact 24. On the contrary, when the normally open movable contact 67 is closed, the direction of current is naturally reversed, thereby rotating the motor M in a reverse direction to lower the window glass.

There will now be described a wiping function of the contact with reference to FIGS. 2 and 3. As the wiping function is identical in both of the first and second swinging contact plates 50 and 60, FIGS. 2 and 3 simply show the wiping function of the first swinging contact plate 50 only.

Referring to FIG. 2 showing the neutral position of the knob 70, the pin 76 is positioned on the bent portion 52, and a bad conductor 80 such as dust is present between the fixed contact 22 and the normally closed movable contact 57. At this time, the pin 77 not shown in FIG. 2 is similarly positioned on the bent portion 62.

When the knob 70 is swung counterclockwise, the pin 77 is slid on the arm portion 65 of the second swinging contact plate 60, and accordingly the second swinging contact plate 60 is reversely inclined until the normally open movable contact 67 is brought into contact with the fixed contact 26. On the other hand, the pin 76 is slid on the arm portion 55 against the biasing force of the spring 78, and simultaneously the arm portion 55 is elastically deformed to be downwardly curved by the pin 76. Accordingly, the contact position of the normally closed movable contact 57 with the fixed contact 22 is downwardly slipped by a distance S. This condition is shown in FIG. 3. Thus, the bad conductor 80 present between the contacts 57 and 22 is removed therefrom to carry out the wiping operation.

Further, when the movable contact 67 of the second swinging contact plate 60 is closed, a relatively weak arc is generated, and the arm portion 65 is thereafter elastically deformed by the pin 77. Thus, the wiping operation is conveniently carried out by the movable contact 67.

Figure 4:
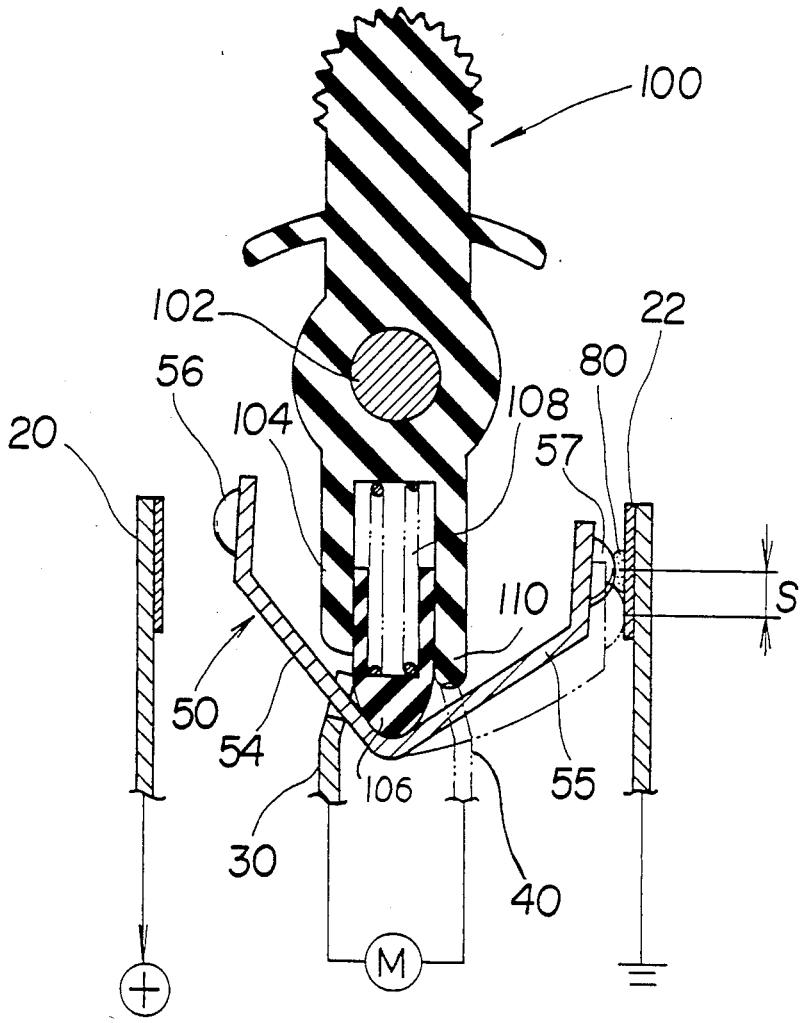
FIG. 4 is a partially enlarged sectional view of the reversing switch in a second embodiment, corresponding to FIG. 2.
Figure 5:
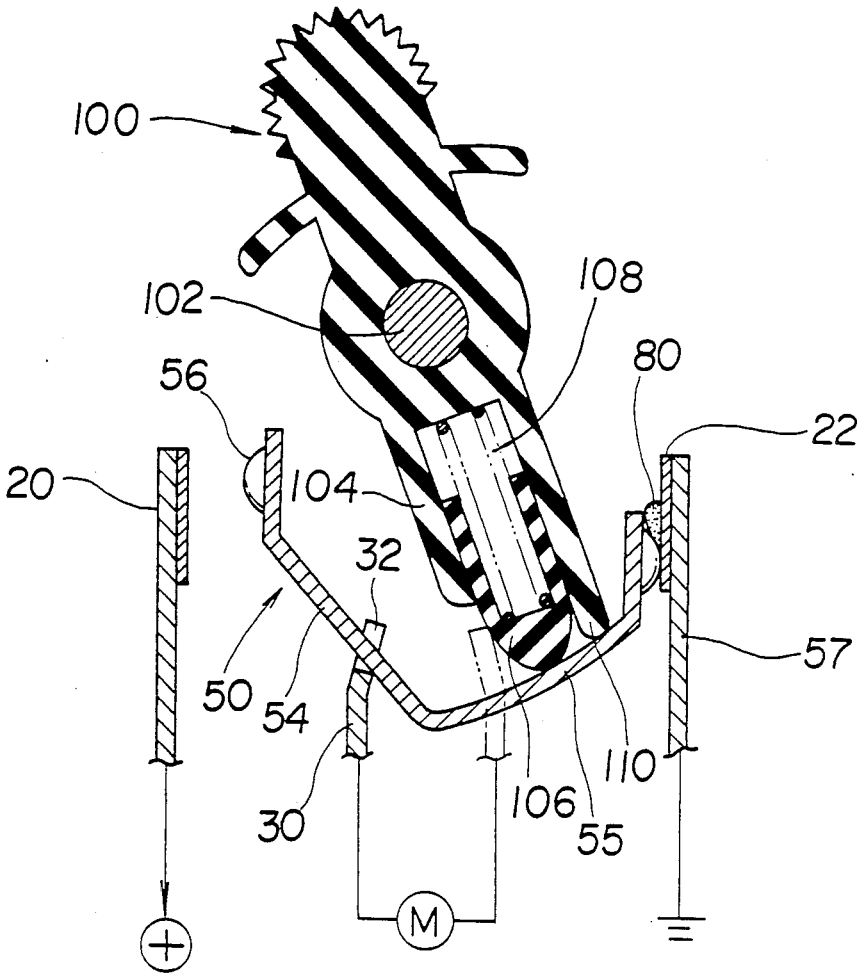
FIG. 5 is a sectional view corresponding to FIG. 3 in the second embodiment.

FIGS. 4 and 5 show a second preferred embodiment different from the first preferred embodiment only in the construction of the lower end portion of the knob. FIGS. 4 and 5 correspond to FIGS. 2 and 3, respectively. For simplicity of explanation, the parts other than the knob are common to those in the first embodiment, and are designated by the same reference numerals A knob 100 is designed to be swung about a shaft 102, and is formed at its lower portion with a pin holder 104. A pin 106 is engaged at the lower end in such a manner as to be projectable and retractable and be biased in the projecting direction by means of a spring 108. In the same manner as of the first preferred embodiment, another pin and another spring are provided at a position symmetrical to the pin 106 in the pin holder 104. The pin holder 104 is integrally formed at the lower end with a projection 110. The projecting amount of the projection 110 is set to a range from a minimum projecting amount of the pin 106 to a maximum projecting amount thereof. Another similar projection is also formed in the vicinity of the other pin forming a pair with the pin 106.

FIG. 4 shows a neutral position of the knob 100. In the neutral position, the projection 110 is maintained in non-contact with the arm portion 55. When the knob 100 is swung counterclockwise, the pin 106 slides on the arm portion 55, and is retracted into the pin holder 104 against the elastic force of the spring 108. Simultaneously, the arm portion 55 is elastically deformed by the projection 110, thereby slipping the contact position of the contacts 57 and 22 by a distance S. Thus, the movable contact 57 conducts the wiping operation to clean off the bad conductor 80 present between both the contacts as shown in FIG. 5. In the second embodiment, the projection 110 serves to reliably elastically deform the arm portion 55 without a loss due to the spring 108. Accordingly, the wiping operation may be carried out accurately and efficiently.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A reversing switch comprising:

a pair of substantially V-shaped swinging contact plates formed of an elastic conductive material, each of said swinging contact plates including vertical projections at the distal ends of the V-shaped contact plate, a normally open movable contact on one of the vertical projections, and a normally closed movable contact on the other of said vertical projections for each said V-shaped contact plate;

a pair of fixed contacts for each of said substantially V-shaped swinging contact plates, said pair of fixed contacts being provided to oppose each of said normally open movable contacts and said normally closed movable contacts, said fixed contacts being vertically oriented and in substantially parallel alignment with said vertical projections of said pair of substantially V-shaped swinging contact plates to form two normally open fixed contacts and two normally closed fixed contacts, wherein each of said normally open fixed contacts is connected to a power source and each of said normally closed fixed contacts is connected to the ground;

intermediate conductive supporting means engaged with each said swinging contact plates for biasing one of said swinging contact plates toward said normally closed fixed contact and for biasing a remaining one of said swinging contact plates away from said normally open fixed contact plate, wherein said intermediate supporting means is positioned on a side of a "V" formed in each of said swinging contact plates which will bias said plates in a predetermined direction; and a knob member pivotably mounted to rest within said swinging contact plates and having means for deforming an arm of each said swinging contact plates upon pivotal actuation of said knob, whereby said means for deforming forces said normally closed movable contact to slide on the surface of said normally closed fixed contact, thereby removing any debris present between said normally closed movable contact and said normally closed fixed contact.

2. The reversing switch as defined in claim 1, wherein said means for deforming comprises a removable pin member projected and retracted at a lower end of said knob, said pin member being biased in a projecting direction by a spring against said arm of each said swinging contact plates, whereby pivotal actuation of said knob forces said pin member to slide along and deform said arm.

3. The reversing switch as defined in claim 1, wherein said means for deforming comprises a projection integrally formed to extend below the pivotal fulcrum of said knob and adjacent a spring-biased pin member, whereby pivotal actuation of said knob forces said pin member to slide along said arm of said swinging contact plate to a plane equal to said projection, said projection and said pin member thereafter jointly deforming said arm.

4. The reversing switch as defined in claim 3, wherein said projection from said knob is fixed at a length corresponding to a minimum projecting length of said pin member from said knob, whereby said pin member is equal in length to said projection when said pin member is completely biased toward said knob.

5. The reversing switch as defined in claim 1, wherein said reversing switch actuates a drive control fo a motor connected to said intermediate conductive supporting means for raising and lowering an automotive window glass, and wherein said intermediate conductive supporting means and said means for deforming are provided for each of said pair of swinging contact plates, said pair of swinging contact plates being inclined in opposing directions, and said pair of fixed contacts being provided on both sides of said movable contacts of each pair of swinging contact plates to form said two normally open fixed contacts and two normally closed fixed contacts.

6. The reversing switch as defined in claim 5, wherein said intermediate conductive supporting means comprise discrete intermediate supporting members formed of a conductive material, and are connected to each other through said motor.

7. The reversing switch as defined in claim 5, wherein said means for deforming include one of said pin members for each of said swinging contact plates, each of said pins being slidable on a predetermined arm of each said swinging contact plate and being projected and retracted within a lower extended end of said pivotable knob by a biased spring member in a projecting direction.

* * * * *